US009309845B2

(12) United States Patent
Gutscher et al.

(10) Patent No.: US 9,309,845 B2
(45) Date of Patent: Apr. 12, 2016

(54) INJECTION DEVICE FOR TWO FUELS CONTAINING ETHANOL, AN INTERNAL COMBUSTION ENGINE, AND A METHOD FOR OPERATING AN INJECTION DEVICE

(75) Inventors: Andreas Gutscher, Markgroeningen (DE); Andreas Posselt, Muehlacker (DE); Marko Lorenz, Grossbottwar (DE)

(73) Assignee: ROBERT BOSCH GMBH, Stuttgart (DE)

( * ) Notice: Subject to any disclaimer, the term of this patent is extended or adjusted under 35 U.S.C. 154(b) by 345 days.

(21) Appl. No.: 13/997,723

(22) PCT Filed: Nov. 9, 2011

(86) PCT No.: PCT/EP2011/069700
§ 371 (c)(1),
(2), (4) Date: Oct. 1, 2013

(87) PCT Pub. No.: WO2012/089388

PCT Pub. Date: Jul. 5, 2012

(65) Prior Publication Data

US 2014/0034015 A1 Feb. 6, 2014

(30) Foreign Application Priority Data

Dec. 27, 2010 (DE) ..... 10 2010 064 182

(51) Int. Cl.
*F02M 43/00* (2006.01)
*F02M 39/00* (2006.01)
(Continued)

(52) U.S. Cl.
CPC ..... *F02M 39/00* (2013.01); *F02D 41/0025* (2013.01); *F02D 41/3094* (2013.01);
(Continued)

(58) Field of Classification Search
CPC ..... F02M 35/10; F02M 35/108; F02M 43/00; F02D 19/08; F02D 41/04
USPC ..... 123/1 A, 27 GE, 299, 300, 302, 304, 123/445, 525–527, 575
See application file for complete search history.

(56) References Cited

U.S. PATENT DOCUMENTS 7,195,000 B2 * 3/2007 Kayama et al. ..... 123/432
8,027,777 B2 * 9/2011 Ichihara et al. ..... 701/103
(Continued)

FOREIGN PATENT DOCUMENTS

| | | |
|---|---|---|
| DE | 10 2006 056574 | 5/2007 |
| DE | 10 2009 000894 | 10/2009 |
| EP | 2 000 663 | 12/2008 |
| JP | 2010 065622 | 3/2010 |

*Primary Examiner* — John Kwon
*Assistant Examiner* — Johnny H Hoang
(74) *Attorney, Agent, or Firm* — Kenyon & Kenyon LLP

(57) ABSTRACT

An injection device for an internal combustion engine having a first injection system for injecting fuel having a first fuel composition, and a second injection system for the injection of fuel having a second fuel composition that has a lower ethanol component than the first fuel composition, the first injection system having at least one first fuel injector for injecting fuel having the first fuel composition both in the direction of a first intake orifice of a combustion chamber of the internal combustion engine, and in the direction of a second intake orifice of the combustion chamber, wherein the second injection system has a second fuel injector for injecting fuel having the second fuel composition essentially only in the direction of the first intake orifice, and a separate third fuel injector for injecting fuel having the second fuel composition essentially only in the direction of the second intake orifice.

10 Claims, 1 Drawing Sheet

(51) Int. Cl.

| | |
|---|---|
| ***F02D 41/00*** | (2006.01) |
| ***F02D 41/30*** | (2006.01) |
| *F02M 35/10* | (2006.01) |
| *F02M 35/108* | (2006.01) |

(52) U.S. Cl.
CPC ..... *F02M43/00* (2013.01); *F02M 35/1085* (2013.01); *F02M 35/10177* (2013.01); *F02M 35/10216* (2013.01)

(56) References Cited

U.S. PATENT DOCUMENTS

| | | | | |
|---|---|---|---|---|
| 8,281,766 | B2 * | 10/2012 | Tomiita et al. | 123/432 |
| 8,689,768 | B2 * | 4/2014 | Saruwatari | 123/299 |
| 2004/0139944 | A1 * | 7/2004 | Nakano et al. | 123/406.47 |
| 2004/0164187 | A1 * | 8/2004 | Kihara et al. | 239/552 |
| 2012/0240670 | A1 * | 9/2012 | Takashima | 73/114.49 |
| 2012/0279472 | A1 * | 11/2012 | Windbergs et al. | 123/445 |

* cited by examiner

FIG. 1
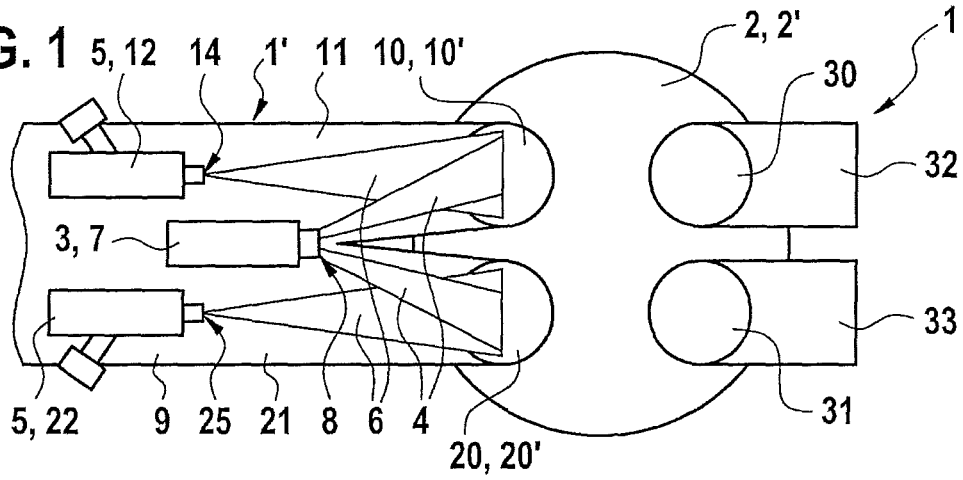
FIG. 2
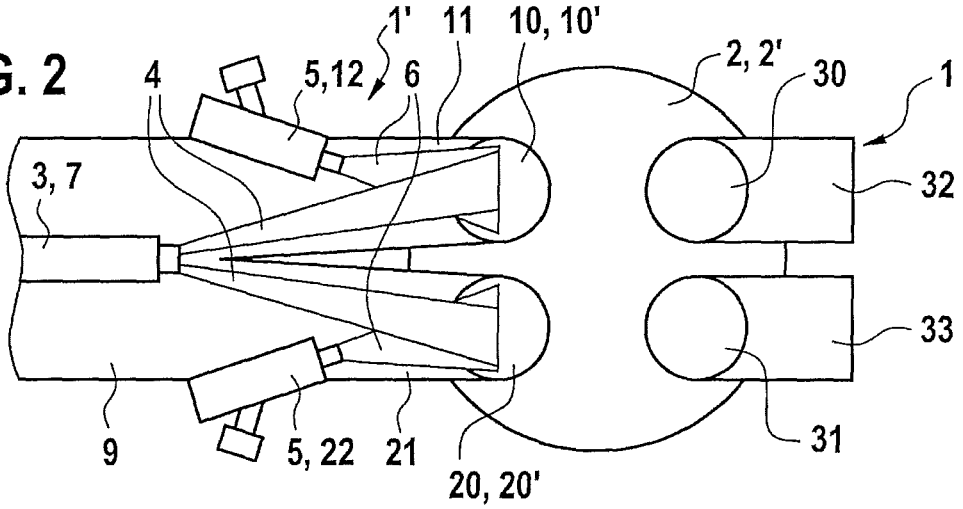
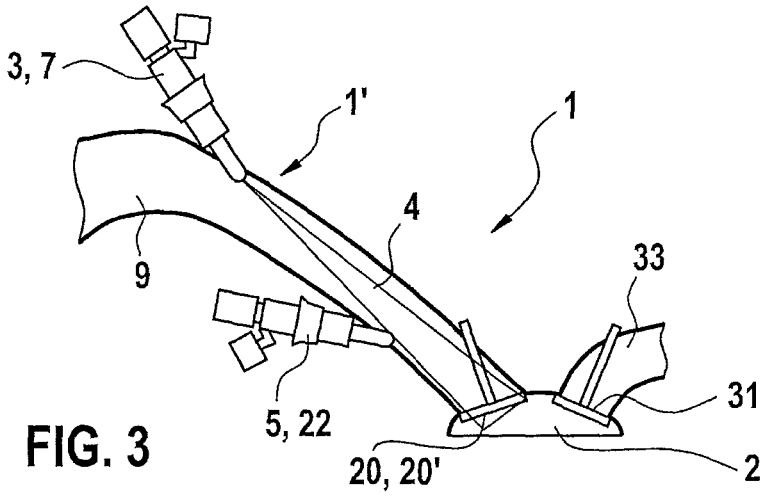
FIG. 3

INJECTION DEVICE FOR TWO FUELS CONTAINING ETHANOL, AN INTERNAL COMBUSTION ENGINE, AND A METHOD FOR OPERATING AN INJECTION DEVICE

FIELD OF THE INVENTION

The present invention is based on an injection device.

BACKGROUND INFORMATION

Injection devices for internal combustion engines are believed to be generally understood. From the printed publication DE 10 2009 000 894 A1, for example, a fuel-supply system is discussed, which supplies mixed fuel containing alcohol and gasoline to a plurality of cylinders of an internal combustion engine. The mixed fuel includes what is called a main fuel and a supplementary fuel, the supplementary fuel having a lower alcohol concentration than the main fuel. The supplementary fuel is injected in the direction of a first and second intake valve of each cylinder by two separate first fuel injectors or by a single second fuel injector. The main fuel is injected in the direction of a first and second intake valve of each cylinder, via the two separate first fuel injectors. The two fuel injectors are therefore used alternatively for the injection of main fuel or supplementary fuel.

SUMMARY OF THE INVENTION

The injection device according to the exemplary embodiments and/or exemplary methods of the present invention, the internal combustion engine according to the present invention, and the method according to the present invention for operating an injection device according to the other independent claim have the advantage that, for one, the exhaust-gas emissions are reduced and, for another, the output of the internal combustion engine is able to be increased.

This may be achieved by injecting the fuel having the first fuel composition, whose main component may be ethanol, using the first injection system exclusively, whereas the fuel having the second fuel compositions, whose main component may be gasoline, is injected using the second injection system having two separate injection valves exclusively. It has been shown that an operation of the internal combustion engine that realizes especially low exhaust emissions is achieved if an operation using fuel of the second fuel composition takes place during the start and in the low-load range of the internal combustion engine, and if an operation using fuel having the first fuel composition takes place in the presence of an increased or full load.

In an operation using an ethanol-based fuel, however, the individual fuel injectors must supply much more fuel volume in comparison with an operation that uses a gasoline-based fuel, which means that the demands with regard to the available flow rate range of the particular fuel injector are relatively high. By separating the fuel injectors into those that inject ethanol-based fuel exclusively, and those that inject gasoline-based fuel exclusively, the high demands on the available flow rate range of the particular fuel injector are met in a simple manner. The injection of gasoline-based fuel is required especially during the startup and warm-up phase, since an injection of ethanol-based fuel for starting the engine is either not possible at all or very inefficient (depending on the ambient temperature).

Therefore, the second injection device is operated in the start-up and warm-up phase, in particular, and throttled or completely switched off if a full load is at hand. The use of two separate fuel injectors, i.e., the second and third fuel injector, facilitates a homogeneous and stable burn-through of the injected fuel in the start-up and warm-up phase, in particular, because each fuel injector has to inject only a reduced through-flow quantity of fuel of the second fuel composition, so that lower spray density is achieved, i.e., the characteristic droplet size, especially the Sauter diameter, of the atomized fuel is advantageously reduced, which results in a more rapid and stable burn-through of the fuel mixture in the combustion chamber. This avoids deficits in the combustion process, ignition faults or incomplete combustion of the fuel mixture, and it reduces the raw exhaust gases.

Especially in the start-up and warm-up phase, i.e., with a cold, as yet not (fully) converting catalyst, this leads to reduced exhaust emissions at the output of the catalytic converter. The better burn-through of the fuel mixture in the combustion chamber furthermore leads to higher temperatures in the combustion chamber and thus also to hotter raw exhaust gases. This heats up the catalytic converter more rapidly in the start-up and warm-up phase, and it reaches the start-up temperature at which the catalytic converter begins to operate efficiently in a faster manner. The use of the two separate fuel injectors thus produces considerably fewer raw exhaust gases overall during the start-up and warm-up phase. Because of the reduced raw exhaust gases, the catalytic converter may advantageously have smaller dimensions, and a portion of the noble metals required for the catalytic converter is able to be saved.

The improved burn-through and the resulting greater running smoothness furthermore allow a lower idling speed, which in turn reduces the exhaust emissions in an operation that uses fuel of the second fuel composition. At high loads, the second injection system is switched off and the internal combustion is supplied with the ethanol-based fuel, which results in a relatively high output at low exhaust emissions and low fuel consumption. The second and third fuel injectors may be dimensioned for a lower fuel flow rate range than the at least one first fuel injector. The second and third fuel injector may have a single-jet characteristic, and the second fuel injector in particular has only a single second injection orifice, while the third fuel injector in particular has only a single third injection orifice. The internal combustion engine according to the present invention may include an Otto engine having manifold injection for a motor vehicle, which may be an automobile. In addition, the internal combustion engine may have more than one cylinder.

Advantageous embodiments and refinements of the exemplary embodiments and/or exemplary methods of the present invention are disclosed by the descriptions in the specification, with reference to the drawings.

According to one specific embodiment, the distance between the second fuel injector and the first intake orifice, and the distance between the third fuel injector and the second intake orifice is smaller in each case than that between the first fuel injector and the first or second intake orifice. The distance between the second injection system and the combustion chamber has been selected to be relatively small, so that the flight times of the injected fuel according to the second fuel composition are shortened. The evaporation of the fuel therefore takes place inside the combustion chamber, which cools the combustion chamber. The knock resistance increases as a result, so that greater outputs are able to be requested, especially in a full-load phase. Therefore, this specific embodiment is suitable for constructing an especially powerful internal combustion engine.

According to one alternative specific embodiment, the distance between the second fuel injector and the first intake orifice, and the distance between the third fuel injector and the second intake orifice is greater in each case than that between the first fuel injector and the first or second intake orifice. The distance between the second injection system and the combustion chamber is relatively large in this way, so that the flight times of the injected fuel according to the second fuel composition are lengthened. This has the advantage that an efficient evaporation of the droplets begins already in the intake manifold, and a relatively stable and hot combustion is thereby achieved in the combustion chamber. Improved ignitability and more rapid heating of the catalytic converter are realized as a consequence, in particular in the start-up and warm-up phase, which lowers the exhaust-gas emissions. As a result, this specific embodiment is suitable for constructing an internal combustion engine that has especially low emissions.

According to one specific embodiment, the second fuel injector is provided for injecting fuel having the second fuel composition into a first intake duct, which discharges into the first intake opening, and the third fuel injector is provided for injecting fuel having the second fuel composition into a second intake duct, which discharges into the second intake opening. In an advantageous manner, the second and third fuel injectors are furthermore situated separately from each other, and in particular are also able to be actuated separately. It is also conceivable that only one of the two fuel injectors is actuated.

According to one specific embodiment, the first fuel injector has a dual-jet characteristic and, in particular, two first injection orifices for the injection of fuel having the first fuel composition, so that the fuel having the first fuel composition reaches both the first and the second intake orifices during the injection. The first fuel injector may be situated in an intake manifold, which discharges into the first and second intake duct. As an alternative, it is of course also conceivable that the first injection system includes two first fuel injectors, which have a single-jet characteristic in each case, i.e., include only one first injection orifice, for example, and are situated in the intake manifold or in the first and second intake duct.

According to one specific embodiment, the second and third fuel injectors have different dimensions, so that different quantities of fuel of the second fuel composition are injected by the second and third fuel injector. This allows for a considerable expansion of the fuel metering range, such as when, for example, only the particular one of the two fuel injectors that is dimensioned for a smaller through-flow quantity is actuated.

Another subject matter of the present invention is an internal combustion engine, which includes an injection device according to the exemplary embodiments and/or exemplary methods of the present invention.

A further subject matter of the present invention is a method for operating an injection device according to the present invention, by which the at least one first fuel injector injects fuel having the first composition, which has a higher ethanol component than the second composition, both in the direction of the first intake orifice and in the direction of the second intake orifice, and the second fuel injector having a single-jet behavior, injects fuel having the second composition only in the direction of the first intake orifice, and a third fuel injector having a single-jet behavior injects fuel having the second composition only in the direction of the second intake orifice. This advantageously realizes the aforementioned advantages of a reduction in the exhaust gases and the increase in power. The at least one first fuel injector may inject fuel having the first fuel composition exclusively, and the second and third fuel injectors are injecting fuel having the second fuel composition exclusively, so that the maximally possible large flow rate range is achieved.

According to one specific embodiment, predominantly fuel having the second composition is injected by the second and third fuel injector in a start-up or warm-up phase of the internal combustion engine, and in a load phase, predominantly fuel having the first composition is injected by the first fuel injector. In this way the fuels with the different compositions are used for the particular requirements at maximum efficiency.

According to one specific embodiment, the fuel having the second fuel composition is supplied to the second injection system under higher pressure than the fuel having the first fuel composition that is supplied to the first injection system, and/or the pressure under which the fuel having the second fuel composition is supplied to the second injection system is adjusted as a function of operating parameters of the internal combustion engine. This makes it possible to realize different pressures in the two fuel-supply systems. A higher pressure in particular in the fuel-supply system for the predominantly gasoline-containing fuel of the second fuel composition is provided, in comparison with the pressure in the fuel-supply system for the predominantly ethanol-containing fuel of the first fuel composition, whereby the combustion characteristics in the start-up phase of the internal combustion engine, in particular, are able to be improved. In addition, a variation of the pressure of at least one of the two fuel-supply systems as a function of the operating point is conceivable.

Exemplary embodiments of the present invention are illustrated in the drawing and explained in greater detail in the following description.

BRIEF DESCRIPTION OF THE DRAWINGS

FIG. 1 shows a schematic plan view of an internal combustion engine having an injection device according to a first specific embodiment of the present invention.

FIG. 2 shows a schematic plan view of an internal combustion engine having an injection device according to a second specific embodiment of the present invention.

FIG. 3 shows a schematic sectional view of an injection device according to a third specific embodiment of the present invention.

DETAILED DESCRIPTION

In the various figures, identical parts have always been provided with the same reference symbols and are therefore usually labeled or mentioned only once.

FIG. 1 shows a schematic plan view of an internal combustion engine 1 having an injection device 1' according to a first specific embodiment of the present invention, which has a cylinder encompassing a combustion chamber 2, in which a piston 2' is moving. The wall of combustion chamber 2 has a first and a second intake orifice 10, 20, through which an air-fuel mixture is aspirated into combustion chamber 2, and a first and second outlet orifice 30, 31, through which the raw exhaust gases of the combusted air-fuel mixture are expelled from combustion chamber 2 into first and second outlet ducts 32, 33. Internal combustion engine 1 has a first intake valve 10', which is provided for sealing first intake orifice 10 and disposed between a first intake duct 11 and combustion chamber 2. Internal combustion engine 1 furthermore has a second intake valve 20', which is provided for sealing second intake orifice 20 and disposed between a second intake duct 21 and combustion chamber 2. First and second intake duct 11, 21 discharge into a shared intake manifold 9 on a side facing away from combustion chamber 2, and a metered quantity of fresh air is aspirated through intake manifold 9 in the direction of combustion chamber 2 by a throttle valve (not shown) situated in intake manifold 9. Injection device 1' has a first and a second injection system 3, 5, which are provided for injecting fuel 4, 6 in the direction of first and second intake orifices 10, 20 or into first and second intake duct 11, 21.

First injection system 3 includes a first fuel injector 7, which generates two jet components. Toward this end, first fuel injector 7 has two injection orifices 8, in particular, through which fuel 4 having a first fuel composition is simultaneously injected both in the direction of the first and in the direction of second intake orifice 10, 20. The first fuel composition has a high ethanol component, in particular, which ensures a relatively efficient combustion, i.e., one featuring low consumption, low emissions and high output, when internal combustion engine is operating under load. Since the start-up and warm-up phase is very inefficient when using an ethanol-based fuel, injection device 1' also has second injection system 5, which is provided for the injection of fuel 6 having a second fuel composition.

The second fuel composition has a lower ethanol component than the first fuel composition, or no ethanol at all, and encompasses conventional gasoline, in particular. For this purpose, second injection system 5 includes a second and a separate third fuel injector 12, 22. Second fuel injector 12 has a single-jet characteristic, i.e., second fuel injector 12 in particular has only a single second injection orifice 14, through which fuel 6 having the second fuel composition is essentially injected solely in the direction of first intake orifice 10. In analogous manner, third fuel injector 22 has a single-jet characteristic, i.e., third fuel injector 22 may have only a single third injection orifice 24, through which fuel 6 having the second fuel composition is essentially injected solely in the direction of second intake orifice 20. First, second and third fuel injectors 7, 12, 22 are actuable separately from each other.

In the example at hand, the distance between second fuel injector 12 and first intake orifice 10, and between third fuel injector 22 and second intake opening 20 is greater than that between first fuel injector 7 and first or second intake orifice 10, 20. The flight time during the injection of fuel 6 of the second fuel composition thus is increased, so that injected fuel 6 evaporates already in first and second intake duct 11, 21 and better ignitability comes about in combustion chamber 2 as a result.

The combustion therefore takes place at higher temperatures, with the result that a post-connected catalytic converter (not shown) is heated more quickly by the hot exhaust gases in the start-up and warm-up phase of internal combustion engine 1, and therefore reaches its operating temperature more rapidly. Second and third fuel injector 12, 22 are dimensioned for a fuel flow rate range that is lower than that of the at least one first fuel injector 7, since the injection of ethanol-based fuel 4 requires larger quantities to be injected in comparison with the injection of gasoline-based fuel 6. Thus, first fuel injector 7 is used exclusively for the injection of fuel 4 having the first fuel composition, while second and third fuel injector 12, 22 each inject exclusively fuel 6 having the second fuel composition.

The injection of fuel 6 of the second fuel composition takes place predominantly in the start-up and warm-up phase of internal combustion engine 1. The injection of fuel 4 having the first fuel composition, on the other hand, occurs predominantly in the load and full-load phase. By suitable control, first, second and third fuel injector 7, 12, 22 may be controlled as a function of the corresponding operating parameters, so that the ratio between the injected quantity of fuel 4 of the first fuel composition and the injected quantity of fuel 6 of the second fuel composition is controlled according to need and, in particular, continuously, in an effort to achieve the lowest possible emissions at sufficient output. Internal combustion engine 1 may have a plurality of such cylinders. Internal combustion engine 1 may include an Otto engine for an automobile.

FIG. 2 shows a schematic plan view of an internal combustion engine 1 having an injection device 1' according to a second specific embodiment of the present invention. The second specific embodiment basically is similar to the first specific embodiment illustrated in FIG. 1; in contrast to the first embodiment, however, first fuel injector 7 in the second embodiment has a distance from first and second intake orifice 10, 20 that is greater than the individual distance between second fuel injector 12 and first intake orifice 10, or the distance between third fuel injector 22 and second intake orifice 20. In other words: Second and third fuel injectors 12, 22 are situated in closer proximity to combustion chamber 2 than first fuel injector 7. This shortens the flight time for fuel 6 of the second fuel composition, which is injected by second and third fuel injector 12, 22, with the result that fuel 6 evaporates in combustion chamber 2 and combustion chamber 2 is cooled. In an operation under full load, this results in higher knock resistance.

FIG. 3 shows a schematic sectional view of an injection device 1' according to a third specific embodiment of the present invention, the third specific embodiment being identical to the first specific embodiment illustrated in FIG. 2. Second and third fuel injector 12, 22 are disposed on an underside of first and second intake duct 11, 21, i.e., on a wall, facing combustion chamber 2, of first and second intake duct 11, 21. First fuel injector 7 is situated on a topside of intake manifold 9, i.e., on a wall of intake manifold 9 facing away from combustion chamber 2. As an alternative, it would also be conceivable for first, second and third fuel injector 7, 12, 22 to be situated on the topside or the underside of intake manifold 9, of first intake duct 11 and of second intake duct 21. A placement in which second and third fuel injector 12, 22 is situated on the topside of first and second intake duct 11, 21, and first fuel injector 7 is situated on the underside of intake manifold 9, would be conceivable as well.

What is claimed is:

1. An injection device for an internal combustion engine, comprising:

a first injection system for injecting a fuel having a first fuel composition; and a second injection system for injecting a fuel having a second fuel composition with a lower ethanol component than the first fuel composition, the first injection system having at least one first fuel injector for injecting the fuel having the first fuel composition both in the direction of a first intake orifice of a combustion chamber of the internal combustion engine, and in the direction of a second intake orifice of the combustion chamber;

wherein the second injection system has a second fuel injector for injecting the fuel having the second fuel composition essentially only in the direction of the first intake orifice, and a separate third fuel injector for injecting the fuel having the second fuel composition essentially only in the direction of the second intake orifice, wherein the distance between the second fuel injector and the first intake orifice, and the distance between the third fuel injector and the second intake orifice is smaller in each case than the distance between the at least one first fuel injector and the first or second intake orifice, and wherein at least one of the second fuel injector and third fuel injector are configured to inject the fuel having the second fuel composition into the combustion chamber such that the fuel having the second fuel composition evaporates in the combustion chamber and the combustion chamber is cooled.

2. The injection device of claim 1, wherein the second fuel injector is for injecting the fuel having the second fuel composition into a first intake duct discharging into the first intake orifice, and the third fuel injector is for injecting the fuel having the second fuel composition into a second intake duct discharging into the second intake orifice.

3. The injection device of claim 1, wherein the first fuel injector has a dual-jet characteristic and, two first injection orifices for injecting the fuel having the first fuel composition, and/or the first fuel injector is situated in an intake manifold, which discharges into the first and second intake duct.

4. The injection device of claim 1, wherein the second fuel injector and the third fuel injector have different dimensions such that different quantities of the fuel having the second fuel composition are injected through the second and third fuel injector and/or the second fuel injector and the third fuel injector are actuatable independently of each other.

5. The injection device of claim 1, wherein the second fuel injector and the third fuel injector are dimensioned for a lower fuel flow rate range than the at least one first fuel injector.

6. An internal combustion engine, comprising:

an injection device, including:

a first injection system for injecting a fuel having a first fuel composition; and a second injection system for injecting a fuel having a second fuel composition with a lower ethanol component than the first fuel composition, the first injection system having at least one first fuel injector for injecting the fuel having the first fuel composition both in the direction of a first intake orifice of a combustion chamber of the internal combustion engine, and in the direction of a second intake orifice of the combustion chamber;

wherein the second injection system has a second fuel injector for injecting the fuel having the second fuel composition essentially only in the direction of the first intake orifice, and a separate third fuel injector for injecting the fuel having the second fuel composition essentially only in the direction of the second intake orifice, wherein the distance between the second fuel injector and the first intake orifice, and the distance between the third fuel injector and the second intake orifice is smaller in each case than the distance between the at least one first fuel injector and the first or second intake orifice, and wherein at least one of the second fuel injector and third fuel injector are configured to inject the fuel having the second fuel composition into the combustion chamber such that the fuel having the second fuel composition evaporates in the combustion chamber and the combustion chamber is cooled.

7. A method for operating an injection device, the method comprising:

injecting, using at least one first fuel injector of an injection device, the fuel having the first fuel composition, which has a higher ethanol component than the second fuel composition, both in the direction of the first intake orifice and in the direction of the second intake orifice, wherein the injection device includes:

a first injection system for injecting a fuel having a first fuel composition, and a second injection system for injecting a fuel having a second fuel composition with a lower ethanol component than the first fuel composition, the first injection system having at least one first fuel injector for injecting the fuel having the first fuel composition both in the direction of a first intake orifice of a combustion chamber of the internal combustion engine, and in the direction of a second intake orifice of the combustion chamber, wherein the second injection system has a second fuel injector for injecting the fuel having the second fuel composition essentially only in the direction of the first intake orifice, and a separate third fuel injector for injecting the fuel having the second fuel composition essentially only in the direction of the second intake orifice, wherein the distance between the second fuel injector and the first intake orifice, and the distance between the third fuel injector and the second intake orifice is smaller in each case than the distance between the at least one first fuel injector and the first or second intake orifice, and wherein at least one of the second fuel injector and third fuel injector are configured to inject the fuel having the second fuel composition into the combustion chamber such that the fuel having the second fuel composition evaporates in the combustion chamber and the combustion chamber is cooled;

injecting, using the second fuel injector, the fuel having the second fuel composition essentially only in the direction of the first intake orifice; and injecting, using the third fuel injector, the fuel having the second fuel composition essentially only in the direction of the second intake orifice.

8. The method of claim 7, wherein the at least one first fuel injector is used exclusively for injecting the fuel having the first fuel composition, and wherein the second fuel injector and the third fuel injector is used exclusively for injecting the fuel having the second fuel composition.

9. The method of claim 7, wherein in a start-up phase of the internal combustion engine, predominantly the fuel having the second fuel composition is injected with the aid of the second fuel injector and the third fuel injector, and wherein, in a load phase, predominantly the fuel having the first fuel composition, is injected with the aid of the first fuel injector.

10. The method of claim 7, wherein the fuel having the second fuel composition is supplied to the second injection system under higher pressure than the fuel having the first fuel composition that is supplied to the first injection system, and/or the pressure under which the fuel having the second fuel composition is supplied to the second injection system is adjusted as a function of operating parameters of the internal combustion engine.

* * * * *